United States Patent [19]

Anastasio

[11] Patent Number: 4,833,842

[45] Date of Patent: May 30, 1989

[54] SEGMENTED DECK

[76] Inventor: Jerry Anastasio, 27 E. Webster St., Merrick, N.Y. 11566

[21] Appl. No.: 132,590

[22] Filed: Dec. 14, 1987

[51] Int. Cl.[4] ..... E04H 3/00

[52] U.S. Cl. ..... 52/79.6; 52/299

[58] Field of Search ..... 52/73, 79.6, 664, 730, 52/184, 299

[56] References Cited

U.S. PATENT DOCUMENTS

| | | | |
|---|---|---|---|
| 3,490,800 | 1/1970 | Wissler | 52/730 |
| 3,862,464 | 1/1975 | Arens | 52/644 X |
| 4,229,919 | 10/1980 | Hughes | 52/299 X |
| 4,691,484 | 9/1987 | Wilson | 52/79.6 |

*Primary Examiner*—David A. Scherbel
*Assistant Examiner*—Creighton Smith
*Attorney, Agent, or Firm*—Michael I. Kroll

[57] ABSTRACT

A segmented deck is provided that is built to and extending from exterior side of a building consisting of vertical support members extending upwardly from footings horizontal deck segment members and horizontal brace members secured together and all fabricated out of durable plastic material which will not rot and splinter. A hollow railing is also provided with built-in electrical sockets and lighting fixtures.

4 Claims, 2 Drawing Sheets

SEGMENTED DECK

BACKGROUND OF THE INVENTION

The instant invention relates generally to decks and more specifically it relates to a segmented deck.

Numerous decks fabricated out of wood have been provided in prior art that are adapted to adjoin to the exterior of houses and over a long period of time the decks can rot and splinter. While these units may be suitable for the particular purpose to which they address, they would not be a suitable for the purposes of the present invention as heretofore described.

SUMMARY OF THE INVENTION

A primary object of the present invention is to provide a segmented deck that will overcome the shortcomings of the prior art devices.

Another object is to provide a segmented deck that can be quickly assembled without the use of special tools and contains a railing with built-in electrical sockets and lighting fixtures.

An additional object is to provide a segmented deck that is fabricated out of plastic material which is strong and will not rot or splinter.

A further object is to provide a segmented deck that is simple and easy to use.

A still further object is to provide a segmented deck that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
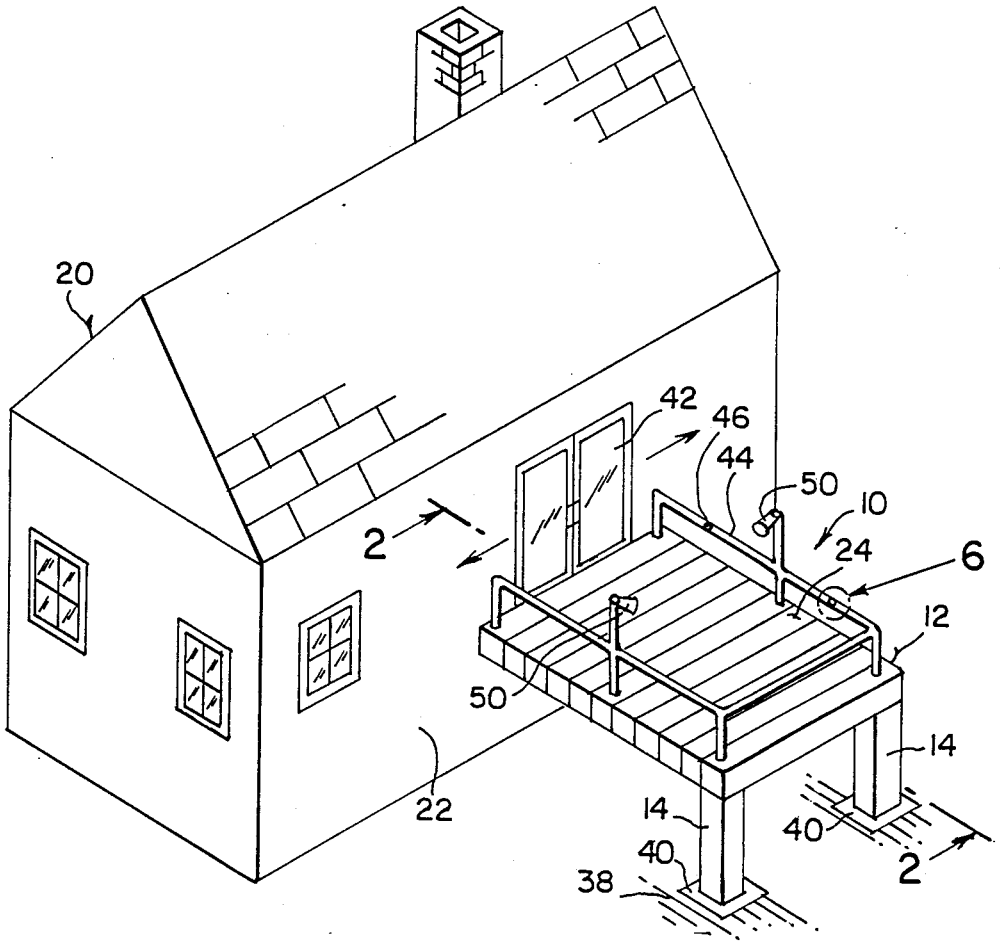
FIG. 1 is a perspective view of a building with the invention attached thereto.
Figure 2:
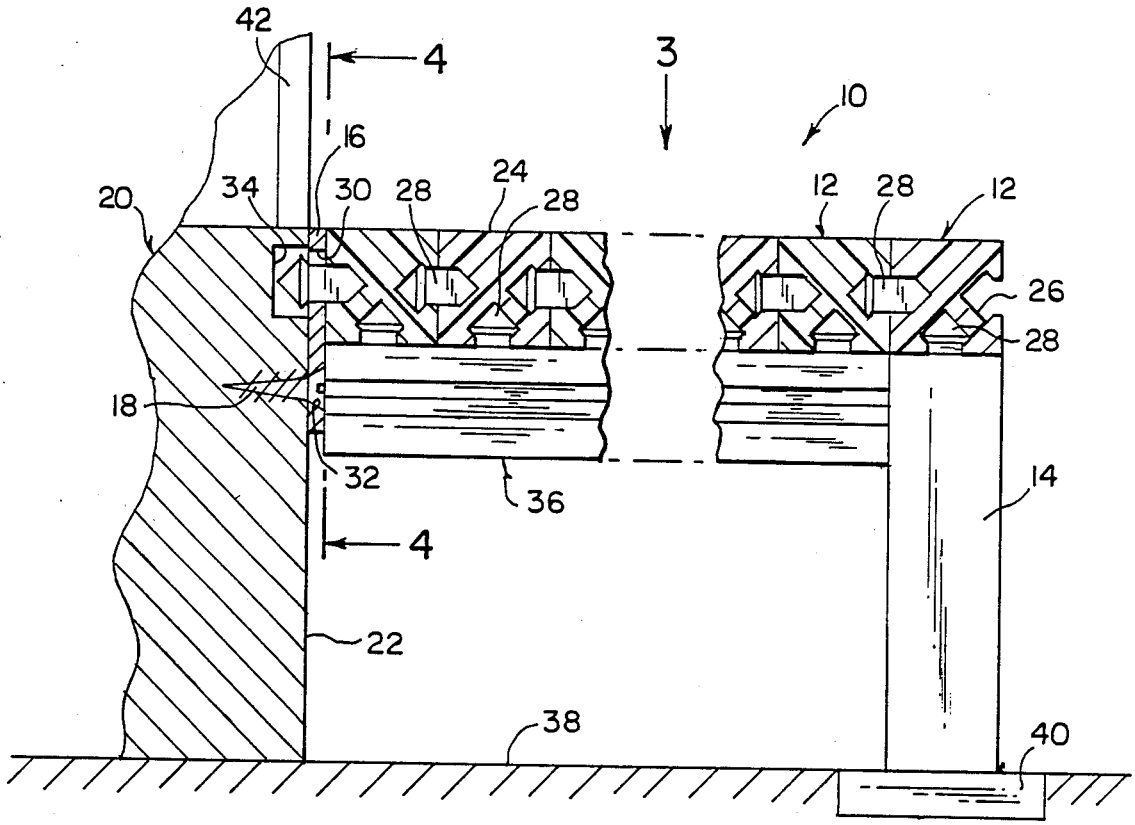
FIG. 2 is a cross sectional view taken along line 2—2 in FIG. 1, with parts broken away.
Figure 3:
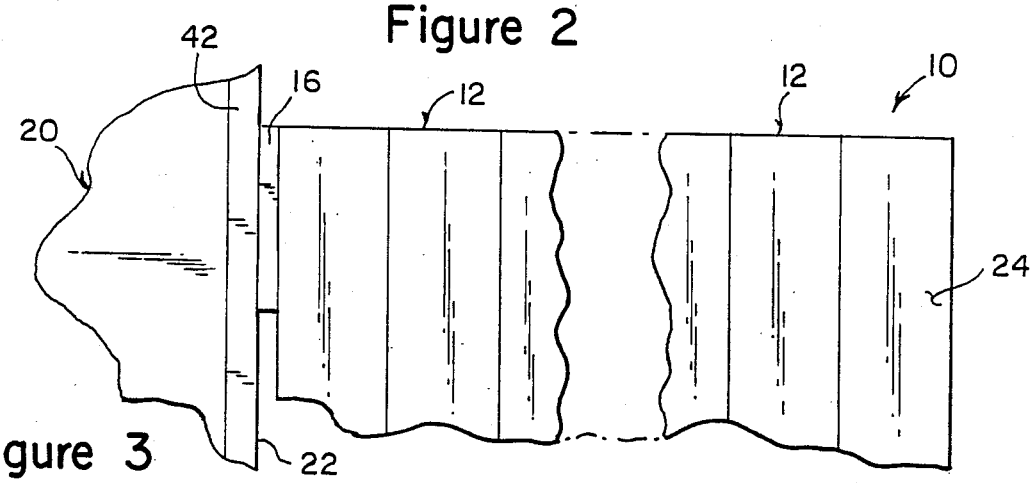
FIG. 3 is a top view taken in direction of arrow 3 in FIG. 1 with parts broken away.

Turning now descriptively to the drawings, in which similar reference characters denote similar elements throughout the several views, FIGS. 1, 2 and 3 illustrate a segmented deck 10 built to side 22 of a building 20 that has a door 42. The segmented deck 10 contains a plurality of footings 40 which are each secured into the ground 38 adjacent the building 20. A plurality of vertical support members 14 are each secured to and extends upwardly from one of the footings 40. A plurality of horizontal deck segments 12 with each having a top flat surface 24 and a plurality of transverse horizontal brace members 36 are also provided.

Figure 5:
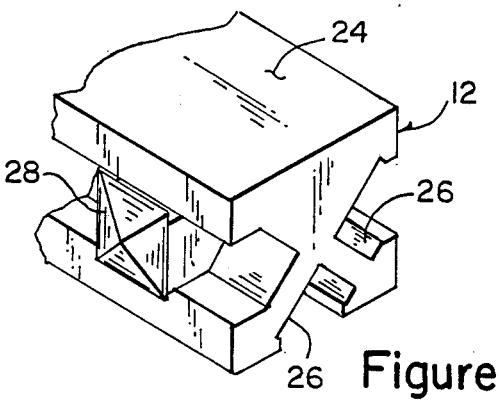
FIG. 5 is a perspective view of a portion of one of the segment members in greater detail.

As best seen in FIGS. 2 and 5, each of the deck segment members 12 has an elongated female socket 26 formed on bottom and one side thereof and a plurality of male plugs 28 formed on opposite side thereof so that each of the male plugs 28 can engage with one of the side female sockets 26 thus securing the deck segment members 12 together.

As best seen in FIG. 2, each of the vertical support members 14 has one male plug 28 on top thereof so that each of the male plugs 28 can engage with the bottom female socket 26 in the outermost deck segment member 12 thus securing the vertical support members 14 to the outermost deck segment member 12.

As best seen in FIG. 2, each of the horizontal brace members 36 has a plurality of male plugs 28 formed on top side thereof so that each of the male plugs 28 can engage with one of the bottom female sockets 26 in each of the rest of the deck segment members 12.

Figure 4:
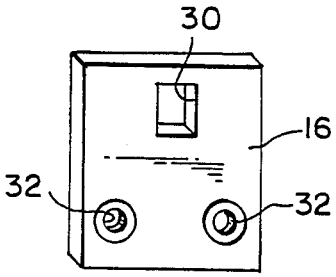
FIG. 4 is a front view of one of the brackets as indicated by line 4—4 in FIG. 2.

As best seen in FIGS. 2 and 4, brackets 16 are provided for attaching side of the innermost deck segment member 12 to the exterior side 22 of the building 20. Each bracket 16 is mounted with screws 18 through screw holes 32 to the exterior side 22 of the building and has an aperture 30 therethrough for receiving one of the male plugs 28 from the innermost deck segment member 12. The exterior side 22 has cutouts 34 for excepting the male plugs 28.

The vertical support members 14, the horizontal deck segment members 12 and the horizontal brace members 36 are all fabricated out of durable plastic material which will not rot and splinter.

Figure 6:
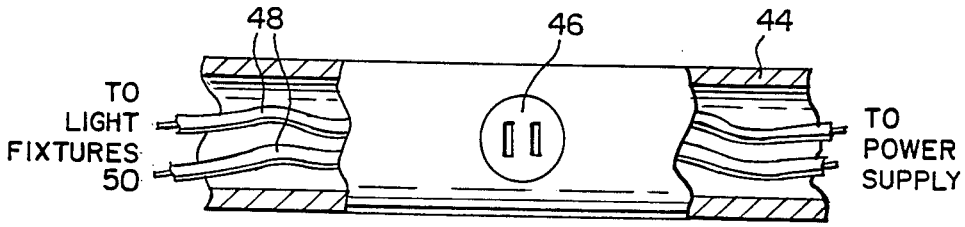
FIG. 6 is an enlarged side view of a portion of the railing as indicated by numeral 6 in FIG. 1, showing one of the sockets and wiring therein.

As shown in FIG. 1 a hollow railing 44 is provided which is secured to perimeter of the top flat surface 24 of the horizontal deck segment members 12 about three sides thereof. A plurality of electrical sockets 46 are formed in the railing 44 while a plurality of light fixtures 50 are secured to the railing. As best seen in FIG. 6, wiring 48 within the railing 44 is connected to the electrical sockets 46 and the light fixtures to supply electrical power thereto.

LIST OF REFERENCE NUMBERS

10. Segmented deck
12. Horizontal deck segment
14. Vertical support member
16. Bracket
18. Screw
20. Building
22. Side of the building
24. Top flat surface
26. Female socket
28. Male plugs
30. Aperture
32. Screw hole
34. Cut out in side of the building
36. Transverse horizontal brace member
38. Ground
40. Footing
42. Door
44. Hollow railing
46. Electrical socket
48. Wiring
50. Light fixture It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A segmented deck built into and extending from exterior side of a building which comprises:

(a) a plurality of footings, each secured into the ground adjacent to the building;

(b) a plurality of vertical support members, each secured and extending upwardly from one of said footings;

(c) a plurality of horizontal deck segment members, each having a top flat surface;

(d) a plurality of transverse horizontal brace members;

(e) means for securing sides of said deck segment members together, securing tops of said vertical support members to bottom of said outermost deck segment member and securing said brace members to bottom of rest of said deck segment members, each of said deck segment members having an elongated female socket formed on bottom and one side thereof and a plurality of male plugs formed on opposite side thereof so that each of said male plugs can engage with one of said side female sockets thus securing said deck segment members together, each of said vertical support members having one male plug on top thereof so that each of said male plugs can engage with said bottom female socket in said outermost deck segment member thus securing said vertical support members to said outermost deck segment member, and each of said horizontal brace members having a plurality of male plugs formed on top side thereof so that each of said male plugs can engage with one of said bottom female sockets in each of rest of said deck segment members; and (f) means for attaching side of said innermost deck segment member to the exterior side of the building.

2. A segmented deck as recited in claim 1, wherein said attaching means includes a plurality of brackets, each of which is mounted to the exterior side of the building and having an aperture therethrough for receiving one of said male plugs from said innermost deck segment member.

3. A segmented deck as recited in claim 2, wherein said vertical support members, said horizontal deck segment members and said horizontal brace members are all fabricated out of durable plastic material which will not rot and splinter.

4. A segmented deck as recited in claim 3, further comprising:

(a) a hollow railing secured to perimeter of the top flat surfaces of said horizontal deck segment members about three sides thereof:

(b) a plurality of electrical sockets formed in said railing;

(c) a plurality of light fixtures secured to said railing; and (d) wiring within said railing connected to said electrical sockets and said light fixtures to supply electrical power thereto.

* * * * *